United States Patent [19]

Hori

[11] 4,004,302

[45] Jan. 25, 1977

[54] AIR-FOAM GENERATING APPARATUS FOR BATH

[76] Inventor: Sanji Hori, 9-29 Sako 6-Bancho, Tokushima, Japan

[22] Filed: May 23, 1975

[21] Appl. No.: 580,288

[52] U.S. Cl. ..... 4/178; 4/180; 128/66; 261/124; 261/DIG. 26; 261/DIG. 78

[51] Int. Cl.[2] ..... A47K 3/10

[58] Field of Search ..... 261/DIG. 26, DIG. 47, 261/DIG. 76, 122, 124, DIG. 78; 4/180, 185 S, 185 R, 178, 187 R; 128/66

[56] References Cited

UNITED STATES PATENTS

| | | | |
|---|---|---|---|
| 1,587,844 | 6/1926 | Landberg | 128/66 |
| 1,922,749 | 8/1933 | Roush | 261/122 |
| 1,950,900 | 3/1934 | McConnell | 261/122 X |
| 2,216,791 | 10/1940 | Simjian | 261/122 X |
| 2,601,225 | 6/1952 | Sandor | 261/122 |
| 2,715,099 | 8/1955 | Stuart | 261/DIG. 47 X |
| 2,774,585 | 12/1956 | Wirts | 261/122 |
| 2,937,506 | 5/1960 | Stirlen | 261/122 X |
| 3,396,950 | 8/1968 | Wood | 261/124 X |

*Primary Examiner*—Frank W. Lutter
*Assistant Examiner*—William A. Cuchlinski, Jr.
*Attorney, Agent, or Firm*—Holman & Stern

[57] ABSTRACT

An improved air-foam generating apparatus adapted for use beneath the water in a bath or wash basin, the apparatus including a diffuser plate of porous material having minute pores ranging from 0.013 mm to 0.48 mm, the diffuser plate comprising a sintered, fine-powdered aluminum oxide grain vitrified at a temperature of 1,300° centigrade. The fine bubbles producing direct and indirect stimuli on the skin of a bather improving the general condition and improving blood circulation.

2 Claims, 3 Drawing Figures

AIR-FOAM GENERATING APPARATUS FOR BATH

FIELD OF THE INVENTION

This invention relates to an improved type of an apparatus for generating air foam in a bath, and the principal object is producing numerous tiny air-bubbles or foams in heavy concentration in the water of a bath or the like, thereby stimulating the skin of a bather.

BACKGROUND OF THE INVENTION

Heavily-concentrated tiny air-foam generated by tiny bubbles from this kind of apparatus in the bath produces a beauty effect on the skin of a human body for the reasons that (1) such heavily-concentrated fine, tiny air-bubbles will give frictional stimulus to the skin as they rise or float up to the water surface in direct contact with the skin surface like a liquid; and (2) a supersonic wave is produced in the water in the process of formation, separation, flowing and vanishing of these air-foams will give a massaging effect to the skin, thereby accelerating blood circulation and metabolism in the human body.

According to the prior art, an apparatus consists of generally a metallic pipe provided with small holes on its peripheral surface, which pipe lays on the bottom of a bath and through which the compressed air is discharged into the water to be formed into an air-foam. According to this method, however, air-foam is generated only in one small part of the bath where the flute-like pipe is laid. The effect of this air-foam produced by this known on the skin of a bather is therefore very small.

With the present invented apparatus, however, air-foam will affect and cover the entire skin of the body of a bather, thereby giving greater stimulation and beauty treatment effect thereto. Moreover, the air-foam formed by the present apparatus comprises a foam which is much smaller size and in much heavier concentration than with the conventional means, thereby enhancing the beneficial stimulus effect.

Furthermore, under the present invention, the novel apparatus can be used in wash basin as well as a bath.

SUMMARY OF THE INVENTION

The present invention provides an improved apparatus for generating air-foam in a bath, whereby it is possible to generate innumerable tiny air-foams in heavy concentration in the water of a bath or a wash basin, for providing a beauty treatment on the skin of a user by means of various direct and indirect stimuli produced by the air-foams.

The nature and other advantages of the present invention will be more clearly understood from the following description made with reference to the attached drawings in which:

DESCRIPTION OF PREFERRED EMBODIMENTS

Figure 1:
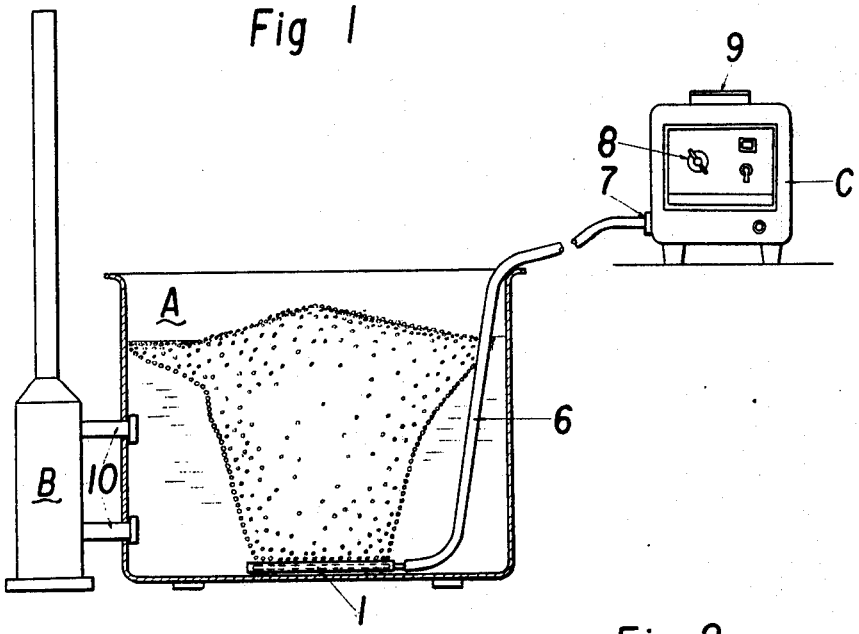
FIG. 1 shows an embodiment of the present invention as used in an ordinary bath, showing it in the operating condition in partly vertical cross-section.
Figure 2:
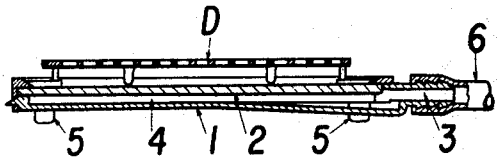
FIG. 2 is an enlarged view, in vertical cross-section, air-foam generating device of the shown in FIG. 1.

Referring to FIG. 1 and FIG. 2 showing an embodiment used in an ordinary bath tub, A indicates a bath, B a gas water-boiler and C compressed-air supply device.

The main part 1 of this foam generating apparatus is placed on the bottom of the bath A, comprising a hollow case with a top plate or an air-foam generating plate 2 produced from a porous material having a large number of heavily-concentrated tiny pores forming air passages. The hollow case carries at its one end an air inlet 3 communicating with an air chamber formed in this case member indicated by the numeral 4.

The foam-generating plate 2 is made, for example, of a porous material such as porcelain produced by sintering fine-powdered aluminium oxide grain vitrified ($Al_2O_2$) at a temperature of 1,300° C. This porous porcelain plate is provided with innumerable fine air pores of diameters ranging from 0.013 mm to 0.48 mm in heavy concentration. These pores run through the plate 2 from its upper surface to the under-surface in straight meandering lines.

With this arrangement of the pores in the plate 2, when water is poured on the plate 2 in such a manner as not to spread outerward, the water will not run down through the plate instantly but will ooze out downwardly to the under-surface in a gradual process.

In FIG. 2, a set of leg members 5 are fixed to the main part 1 of the foam generating device and the symbol D indicates a drain board to hold the feet thereon at the bather; the leg members 5 and drain board D do not constitute elements of the present invention.

Regarding the compressed-air supply device C separately installed remote from the bath A, its interior structure is not shown in the drawings, but comprises a motor and an air-blower fan, whereby outside air is drawn in through a filtering air inlet 9, is compressed or pressurized, and then is ejected through an air outlet 7; this device C is a conventional type of air blower having, for example, a similar blowing capacity to that of ordinary home vacuum cleaner, and indicated at 8 is a dial for adjusting the blowing pressure.

The compressed-air supply device C is connected to the main part 1 of the foam generating apparatus by means of an air conduit 6 having one end connected to the air outlet 7 and its other end connected to the air inlet 3 of device 1 in the bath.

The air supply device C is desirably installed at a position higher than the anticipated water level of a bath A as illustrated in the drawings, so the water current in the bath will not be reversed when device C is not in operation. In case, this device C is installed at a position lower than the anticipated water level of the bath, the conduit 6 should be so arranged as to be raised up to the upper edge of the bath once and then led over the edge into the bath. The numeral 10 in FIG. 1 indicates a communicating pipe between the bath A and the gas water-boiler B.

Under such structural arrangement, the foam generating apparatus operates in such a way that the compressed or pressurized air is fed into the air chamber 4 of the main part 1 of the foam generating device from the air supply device C through the air conduit 6, whereupon the air is ejected or discharged, dispersing into the warm water of the bath A through the pores of the foam generating plate 2 or the top place of the air chamber 4.

The ejected or discharged air is turned into air-foams which start rising instantly. The formation and floating-up of these tiny air-foams will continue for as long as the supply of compressed air is continued by the action of the air supply device C. According to an experiment, the size of the foams generated by the porous plate 2 can be made as large as several times to more than 10 times that of each pore provided in the plate 2.

The foams continuously produced in the bath water in heavy or dense concentration will by themselves give frictional stimulus to the skin as they come to touch the skin and float upward in direct contact with the skin surface. At the same time, the formation, separation, flowing or floating up and vanishing of these numerous air-foams will generate vibrations and produce supersonic waves in the warm water, which gives vibrational stimulus to the human skin. These stimuli combined will provide a massaging effect to the skin, accelerating blood circulation and metabolism in the human body.

Figure 3:
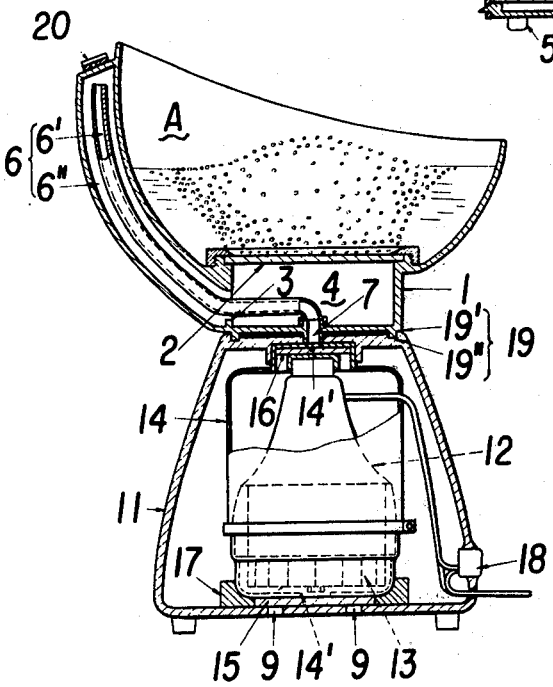
FIG. 3 shown another embodiment of the invention as applied to a wash-basin, showing it in the operating condition and partly in vertical cross-section.

Next, referring to FIG. 3, there is shown an embodiment of the invention as applied to a face-wash basin, there is no substantial structural difference from the embodiment used in the bath in FIG. 1, excepting, naturally, the size and shape. The structure in this application is as follows:

The foam generating device 1 is placed on the bottom of a basin A, comprising a hollow case member with a top plate or an air-foam generating plate 2 made of porous material (as previously described) having a large number of heavily-concentrated tiny pores for air passage purposes. This case member is provided at its one end with an air inlet 3. The main part 1 of the foam generating device is connected through a separate air conduit 6 to the compressed-air supply device C.

For the convenience of installation and operation, however, the embodiment shown in FIG. 3 is so designed that the compressed-air supply device C is mounted immediately below the wash-basin A so as to be formed into one solid functional unit with the basin A, as described below.

Referring to this design, a housing or case member 11 accommodates therein the compressed-air supply device C. The housing 11 is provided with an air inlet 9 at its bottom part and an air outlet 7 at its upper part. A motor 12 drives an air blower fan 13 mounted beneath the motor 12 for the purpose of horizontal revolution or rotation.

A rubber cover 14 is disposed inside the case 11, accommodating therein the motor 12 and fan 13. The rubber cover 14 is provided at its upper and lower parts with openings 14', 14' for connection to the respective air inlet 9 and air outlet. Sponge filter members 15 and 16 are fitted to the openings 14', 14' of the rubber cover 14.

The numeral 17 indicates an anti-vibration rubber plate member 17 surrounds the lower filter 15 and is interposed between the cover 14 and the housing 11. A water-proof switch member 18 for the motor 12 is mounted in the housing 11.

A joint 19 is formed by the mated engagement of a recess 19' on the upper part of the case 11 and a projection 19'' on the underside of the hollow member 4. By fitting the hollow chamber 4 to the upper part of the case 11, the air supply device C, the bath A and the foam generating device 1 are joined together to form one functional unit. At the same time, the air conduit 6, provided at the center of under-side of the hollow chamber 4 is connected to the air outlet 7 provided on the upper part of the case.

The air conduit 6 comprises an upwardly extending pipe 6' which directs compressed air from the air supply device C up above the anticipated water level of the bath A to release the air at a position above the water level, and a downwardly-extending pipe 6'' which conducts air to pipe 6' downwardly from the hollow air chamber 4, at the U-turn point there is provided an outwardly-opening exhaust valve 20.

As to the operation of the embodiment in FIG. 3 described above, the apparatus is preferably placed on a table of suitable height. The motor 12 is turned on whereupon the fan 13 starts its motion air is taken into the air inlet 9 filling up the rubber cover 14 and is directed into the hollow chamber 4 through the outlet 7 and the conduit 6, and then ejected or discharged into the basin A through generating plate 2 of the foam device 1.

When water is put in the basin A after the air is ejected into the basin A, the water which has run into the foam generating plate 2 does not leak into the hollow chamber 4 and when water is put in the basin A before the air is ejected into the basin A, the water gets into the foam generating plate 2 and the hollow member 4, however, this does not present any problem or difficulty when ejecting the compressed air into the basin A.

As easily understood from the above description, a user of this type of a wash-basin will stand in front of the basin, bend down over it and soak the face in the basin water; soaking and washing is done several times, to permit breathing and the skin receives both frictional and vibrational stimuli by the air-foams generated in the water of the basin. These stimuli give a massaging effect to the skin, thereby accelerating blood circulation and metabolism and hence producing a beauty effect on the face.

When this operation was finished, the basin A with the foam generating device 1 is detached from the case member by separation at the joint 19 so that used water can be discharged. If any water settled in the hollow chamber 4, due to the passage of the basin water through the plate 2, such water can also be discharged or thrown out through the exhaust valve 20.

Having thus described the nature and features of the invention, what I claim herein is as follows:

1. In a foam-bathing apparatus, an air-foam generating apparatus for use beneath a body of bathing water comprising a hollow case including a porous foam-generating plate overlying the hollow case, said porous plate including a plurality of meandering passages communicating outer and interior surface of said porous plate with the interior of said case; means for directing pressurized air into said hollow case and out through said porous plate passages for passing through the body of bathing water, said passages having diameters ranging from 0.013 mm to 0.48 mm and producing sonic waves when pressurized air is forced through said passages so that a user's skin is subjected to both frictional and vibrational stimuli by air-foams generated beneath the surface of the body of bathing water and engaging a user's skin, said generating plate consisting of a porous porcelain material comprising sintered aluminum oxide grain vitrified ($Al_2O_2$) produced at a high temperature with the use of an inorganic bonding agents.

2. In a foam-bathing apparatus, an air-foam generating apparatus for use beneath a body of bathing water comprising a hollow case including a porous foam-generating plate overlying the hollow case, said porous plate including a plurality of meandering passages communicating outer and interior surfaces of said porous plate with the interior of said case; means for directing pressurized air into said hollow case and out through said porous plate passages for passing through the body of bathing water, said passages having diameters ranging from 0.013 mm to 0.48 mm and producing sonic waves when pressurized air is forced through said passages so that a user's skin is subjected to both frictional and vibrational stimuli by air-foams generated beneath the surface of the body of bathing water and engaging a user's skin, said hollow case comprising motor means and a blower fan therein, a cover disposed about said motor means and blower fan, air inlets and outlets communicating with said hollow case, a wash basin supported on said hollow case, cooperating separable joint means between said wash basin and hollow case for permitting waste water to be disposed of, said foam-generating plate overlying the bottom portion of said wash basin, said wash basin including a hollow chamber communicating with the outlet of said hollow case through an elongated conduit having an outlet, enclosed within a chamber portion of said wash basin terminating substantially adjacent to an upper portion of the wash basin for being disposed above the level of liquid normally used in the wash basin.

* * * * *